United States Patent [19]

Welch

[11] 4,294,026

[45] Oct. 13, 1981

[54] ELEVATING EARTH SCRAPER

[75] Inventor: James A. Welch, Black Canyon City, Ariz.

[73] Assignee: Sanner Contracting Co., Phoenix, Ariz.

[21] Appl. No.: 150,153

[22] Filed: May 15, 1980

[51] Int. Cl.[3] ..... E02F 1/00; E02F 9/24

[52] U.S. Cl. ..... 37/8

[58] Field of Search ..... 37/7-8, 37/126 AE, 129; 280/152 R

[56] References Cited

U.S. PATENT DOCUMENTS

| | | | |
|---|---|---|---|
| 3,466,765 | 9/1969 | Bernotas et al. | 37/8 |
| 3,564,737 | 2/1971 | Simmons et al. | 37/8 |
| 3,646,693 | 3/1972 | Simmons et al. | 37/8 |
| 3,680,234 | 8/1972 | Scott | 37/8 X |
| 3,890,726 | 6/1975 | Girard et al. | 37/124 |
| 3,997,986 | 12/1976 | Black et al. | 37/8 |
| 4,223,460 | 9/1980 | Black et al. | 37/8 |

*Primary Examiner*—E. H. Eickholt

*Attorney, Agent, or Firm*—Drummond and Nelson

[57] ABSTRACT

An improved earth moving machine for removing topsoil and transporting the soil to another location for unloading and distribution. The earth moving machine includes a frame, a primary mover for the earth moving machine mounted in the frame, a bowl pivotally carried by the frame and having two generally vertical parallel side walls and a scraping edge at the mouth of the bowl for removing topsoil from the ground, an elevator positioned at the mouth of the bowl to carry the soil from the scraping edge upwardly into the bowl, an ejector floor movably secured in the bottom of the bowl to upwardly open and release topsoil carried therein, a pair of ejector floor group members for supporting the ejector floor, each fixed and pivotally carried by a respective bowl wall, a pair of elevator linkage group members, each adjacent to a respective bowl wall and interconnecting the elevator and a respective ejector floor group member. The improvement comprises an improved elevator linkage group member.

3 Claims, 6 Drawing Figures

14a
32b
38a
38
32c
38b
D
32d
32a
32
A
17
22
23
36
37
17a
35
32
25
20
21
6
26
C
5
4
38
34
31
14a
B
14
44
47
49
46
45
48

ELEVATING EARTH SCRAPER

This invention relates to improvements for an earth moving machine.

More particularly, the invention concerns an improved earth moving machine for removing topsoil and transporting the topsoil to another location where the soil is unloaded and distributed over the ground.

Even more specifically, the invention concerns an improved earth moving machine of the type having a frame, a primary mover for the earth moving machine mounted in the frame, a bowl pivotally carried by the frame and having two generally vertical parallel side walls and a scraping edge at the mouth of the bowl for removing topsoil, an elevator positioned at the mouth of the bowl to carry soil from the scraping edge upwardly into the bowl, an ejector floor movably secured in the bottom of the bowl to upwardly open and release soil carried therein, a pair of ejector floor group members for supporting the ejector floor each fixed and pivotally carried by a respective bowl wall, and, a pair of elevator linkage group members each adjacent to a respective bowl wall and interconnecting the elevator and a respective ejector floor group member.

In still another respect the invention relates to an improved earth moving machine having improved elevator linkage group members.

In yet another respect the present invention concerns an improved earth moving machine having elevator linkage group members each pivotally connected at one end to a respective ejector floor group member.

In still a further respect, the invention relates to an improved earth moving machine which functions with increased reliability to substantially reduce the likelihood of the pivotal connections which join the ejector floor group members and their respective bowl walls being damaged or requiring replacement.

The general type of earth moving machine described above is well known in the art and has achieved wide commercial acceptance. Such machines effectively remove and transport large volumes of topsoil and, in general, function properly under most service conditions. However, during operation of the earth moving machine, particularly in rocky topsoils, soil particles tend to lodge between each elevator linkage group member and its respective bowl wall and to gradually force the elevator linkage group members away from the bowl walls. This phenomenon permits progressively larger particles to wedge between the elevator linkage group members and their respective bowl walls until eventually the elevator linkage group members are so extensively damaged that the elevator is no longer maintained in the correct position by the elevator linkage group members and will not properly function. Also, the accumulation of soil particles often causes the ejector floor group members to break free of the pins securing them to their respective bowl walls. In either case, a relatively expensive and time-consuming maintenance procedure is then required to replace and repair the damaged parts and the resulting "down-time" of the earth moving machine can be especially damaging to a company on a tight construction schedule.

It would be highly desirable to provide improvements in earth moving machines of the type described which lead to reduced maintenance and increased long-term mechanical reliability thereof.

In particular it would further be highly desirable to provide an improved elevator linkage group member which would reduce the likelihood of the elevator linkage group members being damaged or of the ejector floor group members separating from their pivotal connections with the bowl walls.

Accordingly, it is a principal object of the instant invention to provide an improved earth moving machine.

Another principal object of the invention is to provide an improved earth moving machine of the type having a frame, a primary mover for the earth moving machine mounted in the frame, a bowl pivotally carried by the frame and having two generally vertical parallel lateral containing walls and a scraping edge in the mouth of the bowl for removing topsoil, an elevator positioned at the mouth of the bowl to carry soil from the scraping edge upwardly into the bowl, an ejector floor movably secured in the bottom of the bowl to upwardly open and empty the bowl of soil carried therein, a pair of ejector floor group members for supporting the ejector floor each fixed and pivotally carried by a respective bowl wall, and, a pair of elevator linkage group members each adjacent along the length thereof to a respective bowl wall and interconnecting the elevator and a respective ejector floor group member.

Another and more specific object of the present invention is to provide an improved earth moving machine of the type having elevator linkage group members which are each pivotally connected at one end to a respective ejector floor group member.

Still another object of the invention is to provide an improved earth moving machine having improved elevator linkage group members.

Yet another object of the invention is to provide an improved earth moving machine having reduced maintenance requirements and increased operational efficiency.

These and other further and more specific objects and advantages of the invention will be apparent to those skilled in the art from the following detailed description and drawings. For the purpose of illustrating the invention, the detailed description set forth below and the drawings depict the invention as employed in a specific type of earth moving machine, i.e. a Model 633D Wheel Tractor-Scraper manufactured by Caterpillar Tractor Company. However, as will be apparent to those skilled in the art, the improved elevator linkage group member described below will be similarly applicable in any other type of earth moving machine wherein an elevator linkage group member is adjacent to a bowl wall and interconnects an ejector floor group member and the elevator.

Briefly, in accordance with my invention, I provide an improved earth moving machine for removing topsoil and transporting the soil to another location for unloading and distribution. Such earth moving machines generally include a frame, a primary mover for the earth moving machine mounted in the frame, a bowl pivotally carried by the frame and having two generally vertical parallel side walls and a scraping edge at the mouth of the bowl for removing topsoil from the ground, elevator means positioned at the mouth of the bowl to carry soil from the scraping edge upwardly into the bowl, ejector floor means movably secured in the bottom of the bowl to be upwardly displaced and release topsoil carried therein, a pair of ejector floor group members attached to the ejector floor means and fixed to and pivotally carried by a respective bowl wall, and a pair of elevator linkage group members each adjacent to a respective bowl wall and interconnecting the elevator means and a respective ejector floor group member.

According to the improvements included in one embodiment of the invention, in the general type of machine described above, I provide improved elevator linkage group members, wherein the elevator linkage group members are shaped, contoured and dimensioned to prevent soil particles from lodging between the elevator linkage group members and said respective bowl walls.

In another embodiment of the invention an elongate guard member is attached to each elevator linkage group member. The elongate guard members have a lip adjacent along the length thereof to the interior surface of their respective bowl walls and positioned above the elevator linkage group members to generally prevent soil particles from downwardly moving between the bowl wall and lip.

In the preferred embodiment of the invention the elongate guard member is attached to each elevator linkage group member and each elevator linkage group member is also shaped, contoured and dimensioned to prevent soil particles from lodging between the elevator linkage group members and their respective bowl walls.

Figure 1:
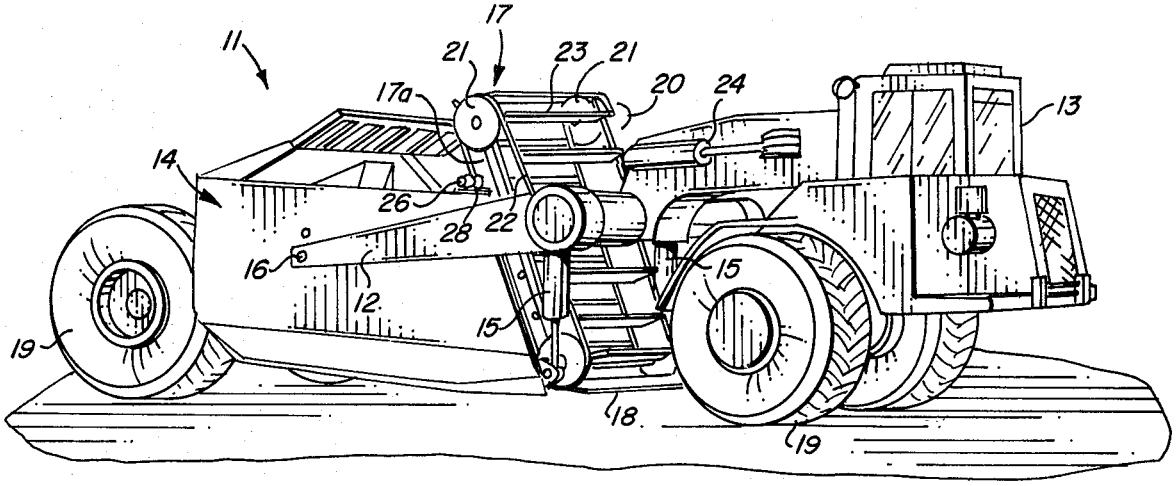
FIG. 1 is a perspective view of an improved earth moving machine which includes the improved elevator linkage group members of the invention.

Turning now to the drawings in which the presently preferred embodiments are shown for the purpose of illustrating the practice thereof and not by way of limitation of the scope of the invention, FIG. 1 is a perspective view showing the general arrangement of the exterior elements of an earth moving machine generally indicated by reference character 11. A frame including draft arms 12 and tractor 13 supports bowl 14. The bowl 14 and tractor 13 are provided with ground engaging wheels 19. Pistons 15 vertically displace the mouth of bowl 14 to pivot bowl 14 about pins 16 carried at the ends of draft arms 12. Elevator 17 carries soil from scraping edge 18 upwardly into bowl 14. Elevator motor 20 rotates driving sprockets 21, the teeth of which engage continuously driven endless chains 22. Flights 23 for carrying soil from edge 18 are mounted along chains 22 at essentially equal intervals. Depending rollers 25 partially support elevator 17 at the mouth of bowl 14 by riding on shock absorbing platforms 26 along the upper edges of bowl 14. Shock absorbers 24 on tractor 13 cushion the ride of bowl 14.

Figure 2:
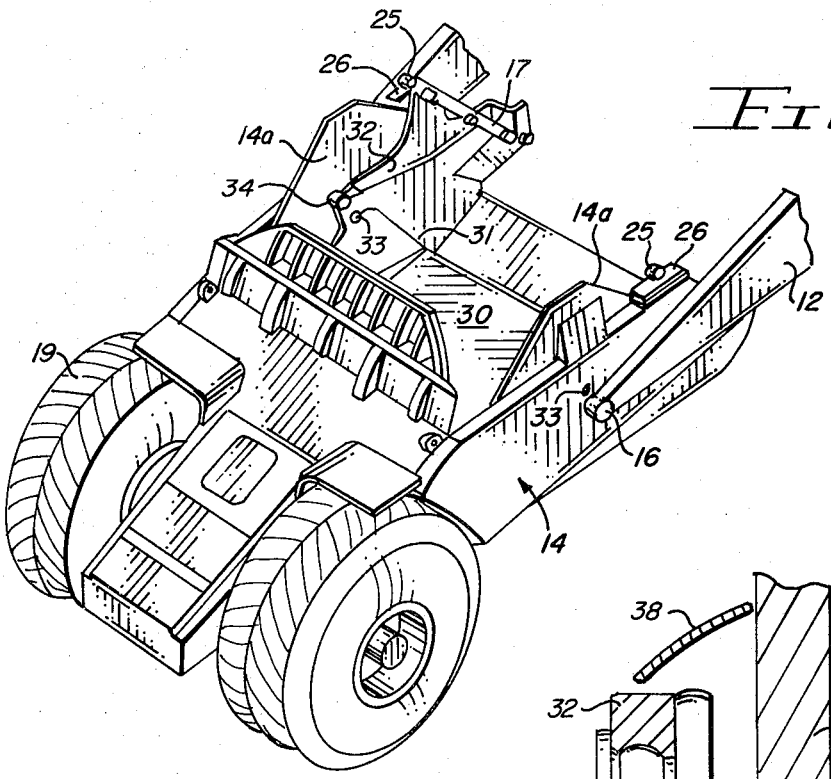
FIG. 2 is a partial elevational perspective view of the improved earth moving machine of FIG. 1, showing the interior of the bowl thereof.

As shown in FIG. 2, the interior of bowl 14 includes ejector floor 30 which upwardly pivots to empty soil carried in the bowl, a pair of ejector floor support members 31 which carry ejector floor 30, and a pair of elevator linkage group members 32. Ejector floor support members 31 are attached to ejector floor 30 and are pivotally mounted to the walls 14*a* of bowl 14 by pins 33. One end of each elevator linkage group member 32 is rotatably connected to a respective ejector floor group member 33 by trunnion pins 34. Elevator linkage group members 32 are fixedly attached to the frame 17*a* of elevator 17 and, along with rollers 25, support elevator 17 at the mouth of bowl 14.

Figures 3, 5, 6:
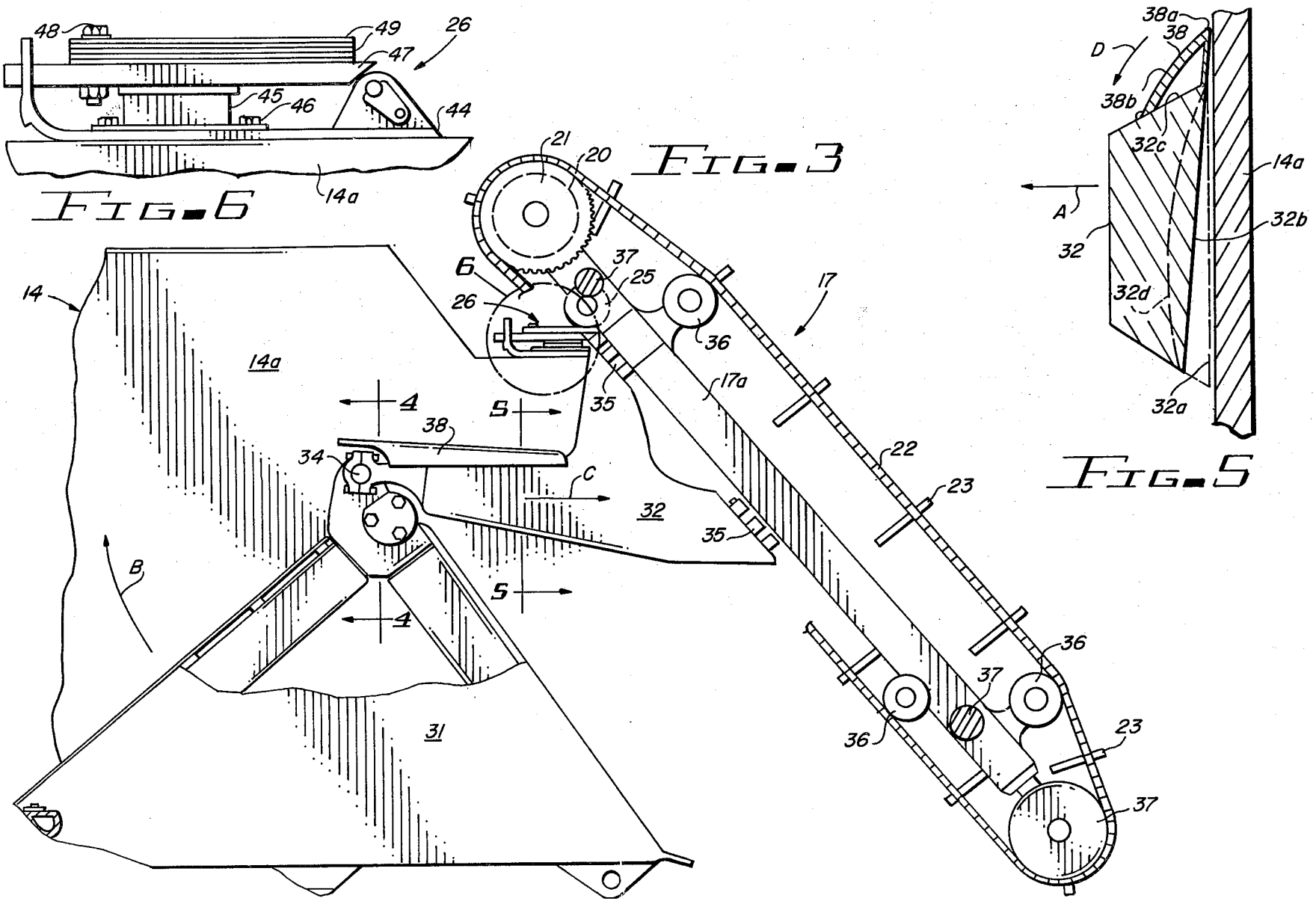
FIG. 3 is an enlarged partial sectional side view of the interior of the bowl of FIG. 2, illustrating details of the ejector floor group member, elevator, and improved elevator linkage group member.
FIG. 5 is a sectional view of the improved elevator linkage group assembly of FIG. 3, taken along section line 5—5 thereof.
FIG. 6 is an enlarged side view of a portion of the earth moving machine of FIG. 3, showing details of the platform apparatus which partially supports the elevator.

In FIG. 3 elevator frame 17*a* is connected to elevator linkage group member 32 by hinges 35. Elevator chain 22 is engaged by the teeth of driving sprocket 21 and by sprocket 37. Rollers 36 further support chain 22 and flights 23 mounted therealong. For clarity, only that portion of elevator 17 adjacent to bowl wall 14*a* is included in FIG. 3. The portion of elevator 17 omitted therefrom would be attached to frame 17*a* by generally horizontal support bars 37. Elongate member 38 is welded or otherwise attached to elevator linkage member 32.

Figure 4:
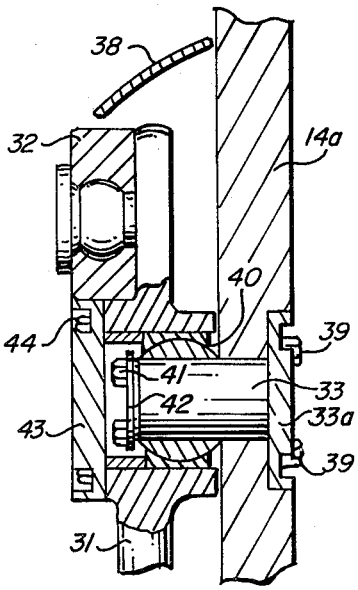
FIG. 4 is a partial sectional view of the ejector floor group assembly and improved elevator linkage group assembly of FIG. 3, taken along section line 4—4 and illustrating details of the connecting pin assemblies thereof.

The pin joint connecting elevator linkage group members 32 to ejector floor group members 31 and the joint pivotally affixing ejector floor group members 31 to bowl walls 14*a* are detailed in FIG. 4. Pin 33 has depending cap 33*a* secured to bowl wall 14*a* by bolts 39. Sleeve bearing 40 supports pin 33. Bolts 41 secure washer 42 to pin 33. Protective retainer cap 43 is affixed to ejector floor group member 31 by bolts 44.

The structural modifications made to elevator linkage group members 32 in the practice of the invention are further illustrated by the cross-sectional view thereof in FIG. 5. As shown by dotted lines 32*a*, in the original configuration of elevator linkage group members 32 the interior surface of members 32 was parallel and adjacent to bowl walls 14*a*. In the invention the interior surface 32*b* of members 32 is angled downwardly and outwardly away from bowl walls 14*a*. Member 38 is welded to member 32 so that lip 38*a* is closer to wall 14*a* than member 32 and thus more effectively prevents soil particles from falling between lip 38*a* and wall 14*a*.

The cushioning platform mechanism 26 supporting each roller 25 of elevator 17 is shown in FIG. 6. L-shaped bracket 44 and rubber pad 45 are affixed to bowl wall 14*a* by bolts 46. Bolt 48 secures plates 49 to base support plate 47.

In operation, scraper 18 of bowl 14 is lowered into contact with the ground by expanding pistons 15 to pivot bowl 14 about pins 16. Soil is lifted from the surface of the scraper upwardly into the interior of bowl 14 by the paddles 23 of elevator 17. When bowl 14 is filled to capacity the earth moving machine is driven to another location. The bowl is emptied by rotating ejector floor group members 31 and the ejector floor 30 attached thereto thereinbetween in a clockwise direction as shown by arrow B in FIG. 3. During this rotation, ejector floor group members 31 rotate about pins 33 mounted in bowl walls 14*a*. This rotation of ejector floor group members 31 causes elevator linkage members 32, elevator 17 and elevator support rollers 25 to move in the horizontal direction indicated by arrow C in FIG. 3. When all soil has been distributed and the bowl emptied, ejector floor group members 31 are rotated in a counterclockwise direction and reassume—along with elevator linkage group members 32 and elevator 17—their normal operating position as pictured in FIG. 3.

Prior to the modification of the elevator linkage group member 32 as illustrated in FIGS. 3–5, soil particles, especially when rocky soil was being loaded into the bowl, would lodge between the interior surface 32*a* of member 32 and wall 14*a* of bowl 14. When ejector floor group members 31 were rotated in the direction of arrow B in FIG. 3 to open the ejector floor 30, these particles would be ground between walls 14*a* and surfaces 32*a* of the elevator linkage group members 32 and would force surfaces 32*a* away from the bowl walls 14*a*. This phenomenon permitted progressively larger pieces of rock to slide between elevator linkage group members 32 and walls 14*a* until eventually members 32 acquired such a significant outward bend that elevator 17 was no longer maintained in its proper operational position by members 32, and, linkage members 32 had to be replaced. In addition, the accumulation and grinding of soil particles between bowl wall 14*a* and elevator linkage group members 32 often forced ejector floor group members 31 off of their bowl wall retaining pins 33 requiring, at a minimum, replacement of the pins. These operational problems, which have been recognized by those of skill in the art for at least the past four years, resulted in substantial down time and maintenance costs in earth scrapers of the type described, specifically in Caterpillar Scraper Models 633C, 633D, and 637. Since soil matter lodged between the elevator linkage group members 32 and walls 14*a* often forced the ejector floor group members 31 from pins 33, Caterpillar Tractor Co. apparently assumed material collecting behind the ejector floor group members 31 was causing the problem and accordingly modified the ejector floor group members 31 in an attempt to resolve the problem. Even with this modification—the placement of a "wiper" along a leading edge of ejector floor group members 31—there was a high frequency of breakage of pins 33. When the elevator linkage group members 32 are modified in accordance with my invention the incidence of pin breakage of pins 33 is greatly reduced.

As illustrated in FIG. 5, the manufacturer's configuration of elevator linkage group members 32 included an interior surface generally parallel to bowl walls 14*a*. This configuration permitted soil particles to accumulate between members 32 and walls 14*a* such that member 32 was gradually outwardly bent in the direction of arrow A. By angling the interior wall of member 32 downwardly away from bowl wall 14*a*, the tendency of soil particles to lodge thereinbetween was greatly reduced. Elongate member 38 is preferably attached to elevator linkage group member 32 so that the gap between lip 38*a* of member 38 and wall 14*a* is less than the normal spacing between member 32 and wall 14*a*. This reduces the size of particulate falling between member 32 and wall 14*a*, and thus minimizes the probability particles will accumulate thereinbetween. In addition, the upper surface 38*b* of member 38 is provided with a greater slope than the upper surface 32*c* elevator linkage group member 32 so that soil particles are more readily "shed" away from bowl wall 14*a* by member 38 in the direction of arrow D in FIG. 5.

As will be apparent to those skilled in the art, the interior surfaces 32*b* of elevator linkage members 32 may be modified in a variety of ways to minimize the tendency of particles to lodge between members 32 and bowl walls 14*a*. For instance, the interior surfaces 32*b* could be convex or, as shown by dashed line 32*d*, concave in shape. Similarly surface 32*c* of member 32 could be constructed with greater slope or as a convex surface to facilitate shedding of soil by member 32. Surface 38*b* of member 38 could also be made concave or otherwise designed to improve shedding of soil particles.

Having described my invention in such terms as to enable those skilled in the art to understand and practice it, and having identified the presently preferred embodiments thereof, I claim:

1. In an earth moving machine for removing topsoil and transporting said soil to another location for unloading and distribution, said earth moving machine including, a frame, a primary mover for said earth moving machine mounted in said frame, a bowl pivotally carried by said frame and having two generally vertical parallel side walls and a scraping edge at the mouth of said bowl for removing topsoil from the ground, elevator means positioned at said mouth of said bowl to carry said soil from said scraping edge upwardly into said bowl, ejector floor means movably secured in the bottom of said bowl to upwardly open and release topsoil carried therein, a pair of ejector floor group members for supporting said ejector floor means, each fixed to and pivotally carried by a respective said bowl wall, a pair of elevator linkage group members, each adjacent to a respective said bowl wall and interconnecting said elevator means and a respective said ejector floor group member, the improved elevator linkage group members, said elevator linkage group members being shaped, contoured and dimensioned to generally prevent particles of said soil from lodging between said elevator linkage group members and said respective bowl walls.

2. The improved earth moving machine of claim 1, further comprising a pair of elongate guard members each attached to a respective said elevator linkage group member, said elongate guard members each having a lip adjacent along the length thereof to said respective bowl wall and positioned above said respective elevator linkage member to generally prevent said soil from downwardly falling between said bowl wall and said lip.

3. In combination with an earth moving machine for removing topsoil and transporting said soil to another location for unloading and distribution, said earth moving machine including, a frame, a primary mover for said earth moving machine mounted in said frame, a bowl pivotally carried by said frame and having two generally vertical parallel lateral walls and a scraping edge at the mouth of said bowl for removing topsoil from the ground, elevator means positioned at said mouth of said bowl to carry said soil from said scraping edge upwardly into said bowl, ejector floor means movably secured in the bottom of said bowl to upwardly open and release topsoil carried therein, a pair of ejector floor group members for supporting said ejector floor means, each fixed to and pivotally carried by a respective said bowl wall, a pair of elevator linkage group members, each adjacent to a respective said bowl wall and interconnecting said elevator means and a respective said ejector floor group member, a pair of elongate guard members each attached to a respective said elevator linkage group member, said elongate guard members having a lip adjacent along the length thereof to said respective bowl wall and positioned above said respective elevator linkage member to generally prevent said soil from downwardly falling between said bowl wall and said lip.

* * * * *